US006289675B1

(12) United States Patent
Herfs et al.

(10) Patent No.: US 6,289,675 B1
(45) Date of Patent: Sep. 18, 2001

(54) HYDRAULIC CONTROL CIRCUIT FOR A PRIORITY AND FOR A SECONDARY HYDRAULIC CONSUMER

(75) Inventors: Werner Herfs; Jacques Maffini, both of Lohr/Main; Thomas Weickert, Hessdorf, all of (DE)

(73) Assignee: Mannesmann Rexroth AG, Lohr/Main (DE)

( * ) Notice: Subject to any disclaimer, the term of this patent is extended or adjusted under 35 U.S.C. 154(b) by 0 days.

(21) Appl. No.: 09/355,412

(22) PCT Filed: Dec. 16, 1997

(86) PCT No.: PCT/EP97/07072

§ 371 Date: Jul. 27, 1999

§ 102(e) Date: Jul. 27, 1999

(87) PCT Pub. No.: WO98/34031

PCT Pub. Date: Aug. 6, 1998

(30) Foreign Application Priority Data

Feb. 4, 1997 (DE) ..... 197 03 997

(51) Int. Cl.[7] ..... F15B 13/00
(52) U.S. Cl. ..... 60/422; 91/516
(58) Field of Search ..... 91/516; 60/422, 60/426, 452

(56) References Cited

U.S. PATENT DOCUMENTS 4,663,936 * 5/1987 Morgan ..... 60/422
5,752,384 * 5/1998 Schmitt et al. ..... 60/426

FOREIGN PATENT DOCUMENTS 2258138 5/1974 (DE) .
3507122 8/1986 (DE) .
3826164 2/1990 (DE) .
4026849 3/1992 (DE) .
4328283 3/1994 (DE) .
4235707 4/1994 (DE) .

* cited by examiner

*Primary Examiner*—Edward K. Look
*Assistant Examiner*—Michael Leslie
(74) *Attorney, Agent, or Firm*—Martin A. Farber

(57) ABSTRACT

The invention concerns a hydraulic control circuit in which the pressure medium conveyed by a hydraulic pump of variable delivery (10) is fed, in each case via a metering aperture (17, 31), as a priority to a first hydraulic consumer (14) and only secondly to a second hydraulic consumer (15). A priority control system is now produced without additional delivery losses and with sufficient amounts of pressure medium being conveyed in that the valve member (48) of the priority valve (45) can be acted upon in the closure direction of the connection between the first connection (46) and the second connection (47) by a pressure prevailing in a line section (13) upstream of the first metering aperture (17).

10 Claims, 3 Drawing Sheets

HYDRAULIC CONTROL CIRCUIT FOR A PRIORITY AND FOR A SECONDARY HYDRAULIC CONSUMER

FIELD AND BACKGROUND OF THE INVENTION

The invention concerns from a hydraulic control circuit, by means of which a primary first hydraulic consumer and a secondary second hydraulic consumer can be supplied with pressure medium in general 1.

Such a hydraulic control circuit is known from DE 43 28 283 A1. In this, the pressure medium flows to the two hydraulic consumers in each case via a metering diaphragm, the first metering diaphragm assigned to the primary first hydraulic consumer being preceded by a pressure compensator, and the second metering diaphragm assigned to the secondary second hydraulic consumer being followed by a pressure compensator. With the aid of the pressure compensators, if a sufficient quantity of pressure medium is delivered, constant pressure differences are maintained via the metering diaphragms, irrespective of the load pressures of the hydraulic consumers, so that the pressure medium quantity flowing to a hydraulic consumer depends only on the opening cross section of the respective metering diaphragm. An adjustable hydraulic pump usually serves as a pressure medium source and is capable of being controlled as a function of the highest load pressure in such a way that the pressure in an inflow line is above the highest load pressure by the amount of a specific pressure difference. The pressure compensator following the second metering diaphragm is acted upon in the opening direction by the pressure downstream of the second metering diaphragm and in the closing direction by a control pressure which prevails in a rear control space and which usually corresponds to the highest load pressure of all the hydraulic consumers supplied by the same hydraulic pump. If a plurality of hydraulic consumers, to which pressure medium flows in each case via a metering diaphragm and a pressure compensator which follows the latter and which is acted upon at the rear by the highest load pressure, are actuated simultaneously, the pressure medium quantities flowing to them are reduced in equal ratio if the pressure medium quantity delivered by the hydraulic pump is lower than the pressure medium part quantities required. A control with load-independent throughflow distribution (LUDV control) is referred to in this case. Hydraulic consumers controlled in this way are called, in brief, LUDV consumers. Since, in an LUDV control, the highest load pressure is also sensed and an inflow pressure lying above the highest load pressure by the amount of a specific $\Delta p$ is generated by the pressure medium source, an LUDV control is a special instance of a load-sensing control (LS control).

There is no load-independent throughflow distribution in the case of a plurality of hydraulic consumers, to which pressure medium flows in each case via a metering diaphragm with a preceding pressure compensator which is acted upon in the closing direction only by the pressure upstream of the metering diaphragm and in the opening direction only by the load pressure of the respective hydraulic consumer and by a compression spring. Only an LS control and an LS consumer are available. DE 43 28 283 A1, then, discloses priority switching between an LS consumer and one or more LUDV consumers, in which the LS consumer is supplied as primary consumer with pressure medium. For this purpose, a priority valve is provided, which has a first connection, connected to a line section upstream of the first metering diaphragm, and a second connection, connected to the load signaling line, and the valve member of which is capable of being acted upon, in the direction of the opening of the connection between the first connection and the second connection, by the load pressure of the primary hydraulic consumer, that is to say of the LS consumer, and by an additional force. The priority valve in the control according to DE 43 28 283 A1 is acted upon, in the direction of the closing of the connection between the first connection and the second connection, by the pressure in the second connection. Although this ensures that the LS consumer is supplied as primary consumer with pressure medium, the pressure in the inflow line is unnecessarily high in specific situations, so that power losses occur. Such a situation arises, for example, when the load pressure of the primary hydraulic consumer is higher than the load pressure of the secondary hydraulic consumer. A pressure lying above the load pressure of the primary hydraulic consumer by the amount of a pressure difference equivalent to the additional force acting on the valve member of the priority valve is then built up in the load signaling line. The regulation of the hydraulic pump, in turn, gives rise, in the inflow line, to a pressure lying above the pressure in the load signaling line by the amount of a specific $\Delta p$, so that the pressure in the inflow line lies above the load pressure of the primary hydraulic consumer by an amount more than the regulating $\Delta p$ at the regulating member of the hydraulic pump.

While a priority control between an LS consumer and an LUDV consumer is disclosable by DE 43 28 283 A1, DE 35 07 122 C2 shows a priority control between two LS consumers. A pressure medium quantity thus flows to these two hydraulic consumers in each case via a metering diaphragm and a pressure compensator which precedes this metering diaphragm and which is acted upon in the closing direction by the pressure upstream of the metering diaphragm. The pressure compensator which is assigned to the primary hydraulic consumer is acted upon in the opening direction by the load pressure of this hydraulic consumer and by a compression spring. The pressure compensator for the secondary hydraulic consumer is acted upon in the closing direction likewise by a compression spring and, moreover, by a pressure picked off between a fixed throttle and a proportional diaphragm which serves as a priority valve and which is connected between the fixed throttle and a tank line and is controlled by the pressure difference at the metering diaphragm of the primary hydraulic consumer. In the event of undersaturation, that is to say when an insufficient quantity of pressure medium is conveyed, the pressure difference at the metering diaphragm of the hydraulic consumer to be supplied as primary consumer with pressure medium decreases, so that the proportional diaphragm opens somewhat, the pressure between the latter and the fixed throttle falls somewhat and the pressure compensator of the hydraulic consumer to be supplied as secondary consumer with pressure medium closes until sufficient pressure medium is available again for the primary hydraulic consumer.

SUMMARY OF THE INVENTION

The object of the invention is to develop further a hydraulic control circuit by means of which an LS consumer is to be supplied with pressure medium as primary consumer with respect to one or more LUDV consumers, in such a way that excessive power losses are avoided during operation.

According to the invention, the valve member of the priority valve can be acted upon, in the direction of the closing of the connection between the first connection and the second connection, by a pressure prevailing in a line section upstream of the first metering diaphragm. In this surprisingly simple solution to the problem, when the load pressure of the LS consumer is higher than the load pressure of a parallel-actuated LUDV consumer, the load signaling line is acted upon by the load pressure of the LS consumer, not by a higher pressure. Consequently, in the inflow line too, only a pressure which lies above the load pressure of the LS consumer by the amount of the regulating $\Delta p$ at the hydraulic pump is built up. If the load pressure of the LS consumer is lower than the load pressure of a parallel-actuated LUDV consumer, the load pressure of the LUDV consumer or the highest load pressure of a plurality of simultaneously actuated LUDV consumers prevails in the load signaling line.

Advantageous refinements of a hydraulic control circuit.

A feature of the invention, the additional force acting on the valve member of the priority valve in the direction of the opening of the connection between the first connection and the second connection is advantageously generated by a spring.

For a regulation which is not susceptible to vibration, it seems favorable if the priority valve is formed as a proportional valve.

The pressure difference at the first metering diaphragm is sensed by the priority valve. Since, in the event of undersaturation, the pressure compensator preceding the first metering diaphragm is fully open, a control space on the valve member of the priority valve can be connected to the inflow line upstream of the first pressure compensator. This may be advantageous in terms of the design of the individual components of the control. It may also be advantageous, wherein a control pressure space on the valve member of the priority valve and the first connection of the priority valve are connected to the inflow to the first metering diaphragm on the same side of the first pressure compensator.

According to a further feature of the invention, there is provided around the priority valve a bypass line which connects a flow point downstream of the first metering diaphragm to the load signaling line and in which is arranged a nonreturn valve opening toward the load signaling line. What is achieved in this way is that, insofar as the LS consumer is load-carrying, that is to say has the highest load pressure, this load pressure prevails in the load signaling line and, if there is a sufficient quantity of pressure medium for all the consumers actuated, the pressure difference is determined via the first metering diaphragm by the preceding pressure compensator. Only in the event of undersaturation is the pressure difference determined by the additional force at the priority valve, to which a lower pressure difference than the spring force at the first pressure compensator is normally equivalent. Another feature of the invention prevents pressure medium from flowing out of the load signaling line into the inflow line when there is still no pressure built up by the hydraulic pump.

BRIEF DESCRIPTION OF THE DRAWINGS

Several exemplary embodiments of a hydraulic control circuit according to the invention are illustrated in the drawings. The invention is explained in more detail with reference to the figures of these drawings in which.

DETAILED DESCRIPTION OF THE PREFERRED EMBODIMENTS

Figure 1:
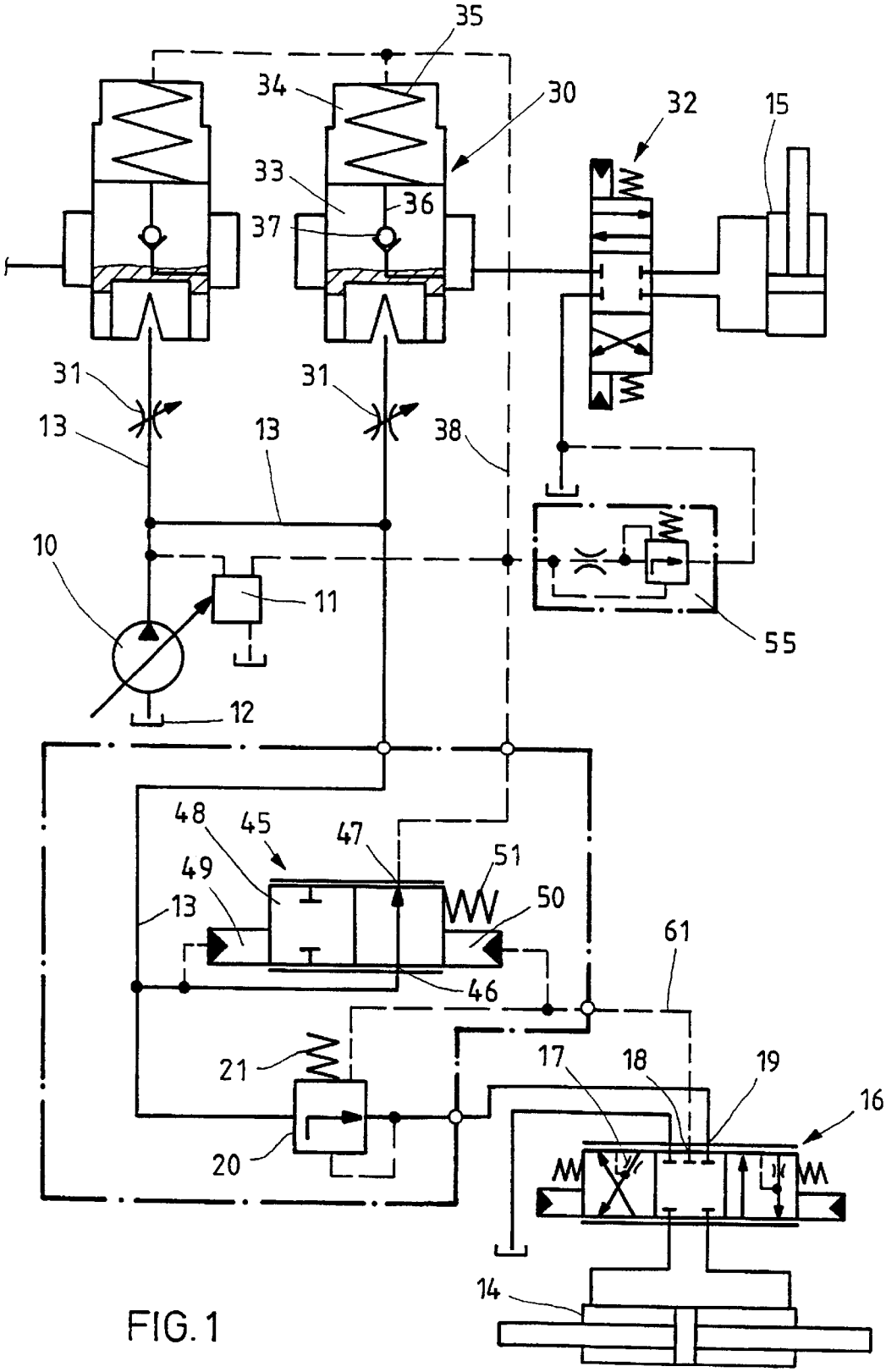
FIG. 1 shows a first exemplary embodiment, in which the first connection and a control space of the priority valve are jointly connected to the inflow upstream of the pressure compensator assigned to the primary hydraulic consumer.

According to FIG. 1, a variable displacement pump 10 with an adjustment means 11 sucks in pressure medium from a tank 12 and discharges it into a system of inflow lines 13. A first hydraulic consumer 14, which is formed as a synchronous cylinder, and at least one second hydraulic consumer 15, which is a differential cylinder, are supplied with pressure medium via the inflow lines. The direction and speed of the synchronous cylinder 14 are determined by appropriate actuation of a 4/3 proportional directional valve 16, the valve slide of which is spring-centered in a middle position, in which the four working connections and a control connection 18 of the directional valve 16 are blocked. When the valve slide is displaced out of its middle position in one direction or the other, a metering diaphragm (device) 17 is opened to a varying extent, depending on the distance over which the valve slide is moved. The control connection 18 is connected, downstream of the metering diaphragm, to the forward flow to the synchronous cylinder 14.

Inserted between the system of inflow lines 13 and an inflow connection 19 of the directional valve 16 is a 2-way pressure compensator 20, the regulating piston of which is acted upon in the direction of the closing by the pressure upstream of a metering diaphragm 17 and in the direction of the opening, via a control line 61, by the pressure in the control connection 18 of the directional valve 16, that is to say by the load pressure of the synchronous cylinder 14, and by a regulating spring 21. The force of the regulating spring 21 is such that a pressure difference of, for example, 15 bar across a metering diaphragm 17 is equivalent to it.

Thus, while the first pressure compensator 20 assigned to the first hydraulic consumer 14 precedes the first metering diaphragm 17, the second pressure compensator 30 assigned to the second hydraulic consumer 15 follows a second metering diaphragm (device) 31. For the directional control of the differential cylinder 15, there is arranged between the second pressure compensator 30 and the differential cylinder a directional valve 32, via which, as compared with the pressure drop at the metering diaphragm 31, an appreciable pressure drop no longer occurs when the differential cylinder 15 is actuated. The metering diaphragm 31 and the control grooves necessary for the directional control are formed in a known way on the same valve slide, so that directional control and speed control in each case readily take place jointly. The regulating piston 33 of the pressure compensator 30 is acted upon at the front, in the direction of the opening of the connection between the metering diaphragm 31 and the directional valve 32, by the pressure downstream of the metering diaphragm and at the rear, in the direction of the closing of the connection, by a control pressure prevailing in a control pressure space 34 and by a weak compression spring 35, to which a pressure of, for example, only 0.5 bar is equivalent. The front side of the regulating piston 33 is connected to the control pressure space 34 via a duct 36 running in the regulating piston, there being arranged in the duct 36 a nonreturn valve 37 opening toward the control pressure space.

Further metering diaphragms, pressure compensators and directional valves for further hydraulic consumers may be connected to the system of inflow lines 13 in parallel with the metering diaphragm 31, the pressure compensator 30 and the directional valve 32 for the second hydraulic consumer 15. In this case, the control pressure spaces 34 of all the pressure compensators 30 are connected to one another, so that the same pressure prevails in these control pressure spaces. When a second hydraulic consumer is actuated, the regulating piston 33 of the pressure compensators seek to assume a position in which a pressure established on their front side is higher than that in the control pressure spaces 34 only by the amount of the pressure difference equivalent to the force of the compression spring 35.

Even if the first hydraulic consumer 14 is ignored completely, the highest load pressure of all the actuated second hydraulic consumers 15 is in each case introduced into the control pressure spaces 34 via the ducts 36 and the nonreturn valves 37.

Figure 4:
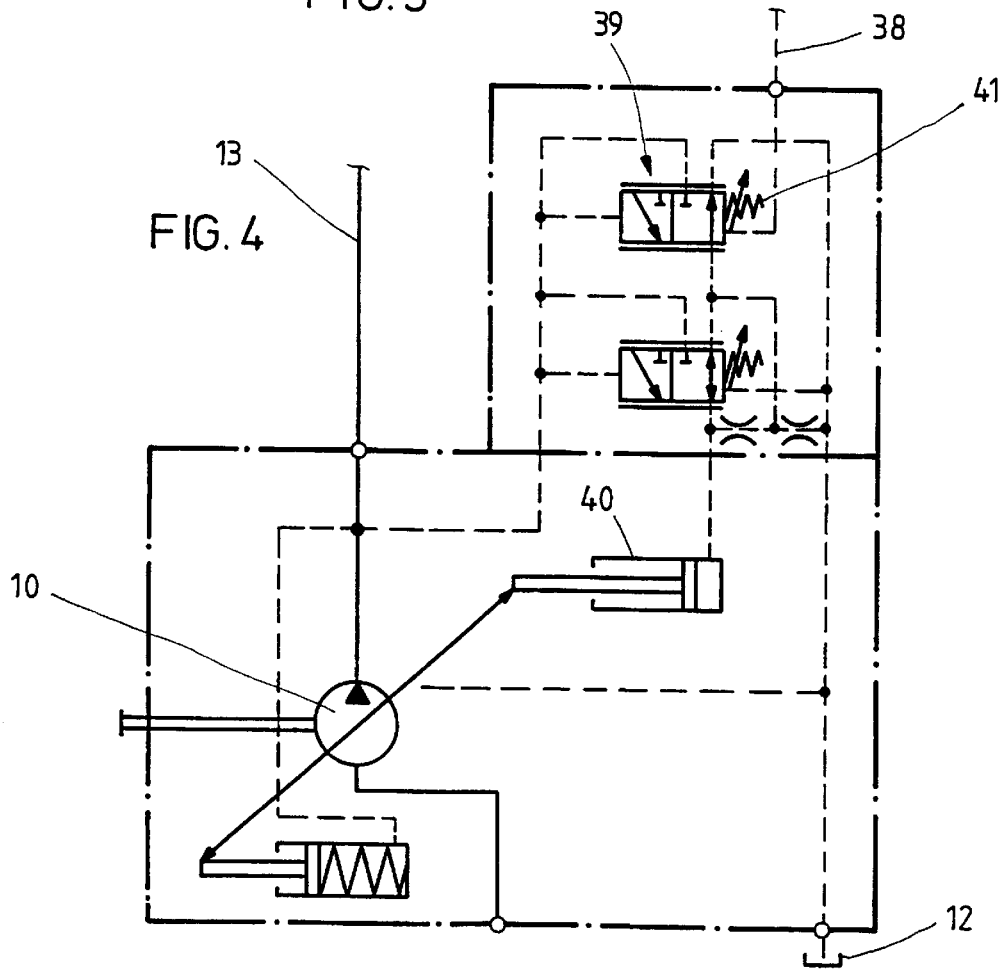
FIG. 4 shows the circuit diagram of a variable displacement pump, including regulating valves, such as is capable of being used in the exemplary embodiments according to FIGS. 1 to 3.

The control pressure spaces 34 are connected to a load signaling line 38 which leads to the adjustment means 11 of the pump 10. In particular, as is apparent from FIG. 4, the load signaling line 38 leads to a regulating valve 39 having three connections, one of which is connected to an actuating cylinder 40 of the variable displacement pump 10. A further connection of the regulating valve 39 is connected to an inflow line 13 and the third connection to the tank 12. The regulating piston of the regulating valve 39 is acted upon, in the direction of connecting the first connection to the second connection, by the pressure in the inflow line 13 and, in the direction of connecting the first connection to the third connection, by the pressure in the load signaling line 38 and by a regulating spring 41. Variable displacement pumps and regulating valves according to the circuit diagram shown in FIG. 4 are generally known and are readily obtainable on the market. There is therefore no need to discuss them in any more detail. It may be pointed out merely that the pump regulation causes a pressure to be established in the inflow line 13 which lies above the pressure in the load signaling line 38 by the amount of a pressure difference equivalent to the force of the regulating spring 41. The pressure difference is, for example, 20 bar, that is to say is higher than the pressure difference of 15 bar equivalent to the force of the regulating spring 21 of the first pressure compensator 20.

The first hydraulic consumer 14 is to be supplied with pressure medium as primary consumer before the second hydraulic consumer 15. For this purpose, a priority valve 45 is provided, which is formed as a proportional diaphragm with an inlet 46 and an outlet 47. The latter is connected to the load signaling line 38. The inlet 46 is connected, upstream of the pressure compensator 20, to an inflow line 13. The valve member 48 of the priority valve is acted upon, in the direction of the closing of the connection between the inlet and the outlet, by a pressure prevailing in a first control pressure space 49 connected to an inflow line 13 and, in the direction of the opening of the connection, by a pressure prevailing in a second control pressure space and by a regulating spring 51. When the directional valve 16 is actuated, the second control pressure space 50 is connected via the control line 61 to a point downstream of a metering diaphragm 17. The load pressure of the first hydraulic consumer 14 then prevails in said second control pressure space. The regulating spring 51 is formed, for example, in such a way that there is an equilibrium of forces at the valve member 48 of the priority valve 45 when the pressure in the first control pressure space 49 is 13 bar higher than the pressure in the second control pressure space 50. This pressure difference is lower than the pressure difference equivalent to the force of the regulating spring 21 of the pressure compensator 20.

The first hydraulic consumer 14, which is to be supplied as primary consumer with pressure medium, is supplied with sufficient pressure medium, without the priority valve 45 having to come into operation, whenever the sum of the load pressure of said consumer, plus the regulating Δp of the adjustment means 11 on the variable displacement pump 10, is a lower than the highest load pressure of all the simultaneously actuated second hydraulic consumers 15. This is because pressure medium always flows to the hydraulic consumer having the lowest load pressure.

The situation will be considered then, where the load pressure of the first hydraulic consumer 14 is higher than the highest load pressure of all the simultaneously actuated second hydraulic consumers 15. It may, for example, be 80 bar, while the highest load pressure of the LUDV consumers may be 60 bar. When the directional valve 16 is actuated, 80 bar then prevail in the control pressure space 50 of the priority valve 45. Together with the 13 bar of the regulating spring 51, 93 bar act in the opening direction of the proportional valve 45. An equilibrium of forces is established at the regulating piston of this valve when 93 bar prevail in the first control pressure space 49. Since these 93 bar are higher than the pressure in the load signaling line 38 by the amount of the regulating Δp of the pump regulating valve 39, a pressure of 73 bar prevails in the load signaling line 38 in accordance with the regulating Δ of the variable displacement pump 10 which is in the amount of 20 bar. This pressure also prevails in the control spaces 34 of the pressure compensators 30. Their metering diaphragms 31 may still be closed. Since, then, the pressure in the system of inflow lines 13 lies above the load pressure of the primary hydraulic consumer 14 by the amount of only 13 bar, the pressure compensator 20 is fully open and there is a pressure drop of only 13 bar across the metering diaphragm 17. If, then, a second hydraulic consumer 15 is to be actuated, the corresponding metering diaphragm 31 is opened and the corresponding directional valve 32 is displaced out of its middle position. Disregarding the influence of the compression spring 35, the same pressure is established between the metering diaphragm 31 and the following pressure compensator 30 as in the control pressure space 34, specifically a pressure in the amount of 73 bar. For only then does an equilibrium of forces prevail at the regulating piston 33 of the pressure compensator 30. Since the pressure is around 93 bar in the system of inflow lines 13, the pressure difference across a metering diaphragm 31 amounts, as desired, to 20 bar in accordance with the regulating Δp of the variable displacement pump 10.

If, then, an increasingly greater pressure medium quantity is demanded from the pump as the result of increasing the opening cross section of a metering diaphragm 17 or as the result of increasing the opening cross sections of a plurality of metering diaphragms 31, said pump finally reaches its point of maximum adjustment, from which there can be no further increase in the pressure medium quantity. This leads to a reduction in the pressure in the system of inflow lines 13 and consequently in the first control pressure space 49 of the priority valve 45. The regulating piston 48 of the latter is displaced in the direction of the opening of the connection between the connections 46 and 47, so that the pressure in the load signaling line 38 and in the control pressure spaces 34 of the pressure compensators 30 rises. The regulating pistons 33 of the latter, in turn, reach a state of equilibrium when the pressure between the metering diaphragms 31 and the pressure compensators 30 is also increased to the value of the pressure in the control pressure spaces 34. The pressure difference across the metering diaphragms 31 is then lower than the regulating Δp of the pump 10 in the amount of 20 bar. The pressure medium quantity flowing across the metering diaphragms 31 is reduced correspondingly. Specifically, it is reduced to an extent such that a pressure of 93 bar is maintained in the system of inflow lines 13. For only then does an equilibrium of forces prevail at the regulating piston 48 of the priority valve. Thus, while the pressure difference across the metering diaphragms 31 is reduced, the pressure difference in the amount of 13 bar is maintained across the metering diaphragm 17. In an extreme case, the pressure in the load signaling line 38 and in the control pressure spaces 34 of the pressure compensators 30 rises to 93 bar, so that pressure medium no longer flows across the metering diaphragms 31.

Figure 2:
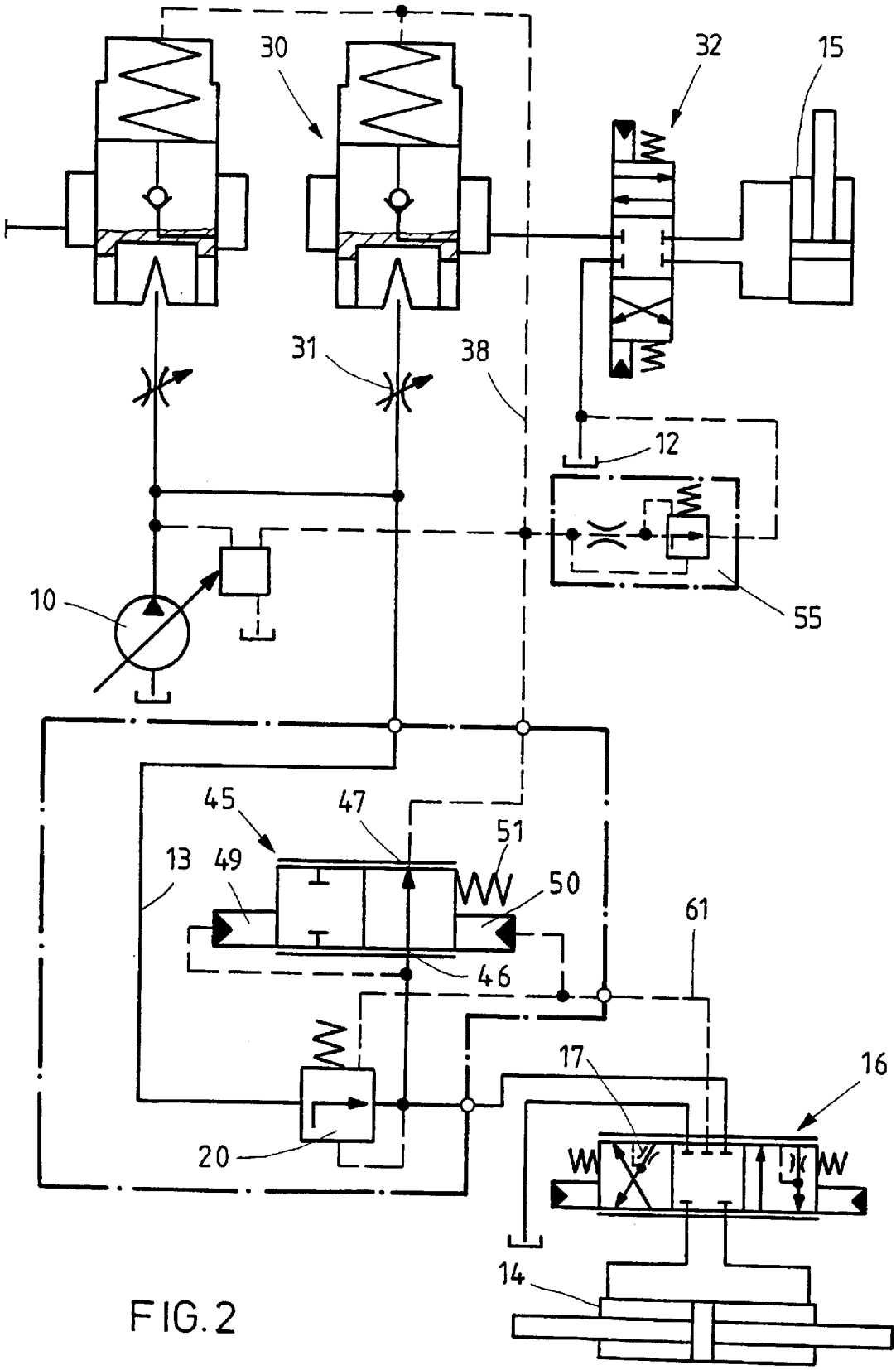
FIG. 2 shows a second exemplary embodiment, in which the first connection and a control space of the priority valve are connected to the inflow downstream of the pressure compensator.

In the undersaturation situation described, the pressure compensator 20 assigned to the primary hydraulic consumer 14 is fully open. The same pressure therefore prevails at the outlet of the pressure compensator as at the inlet and in the system of inflow lines 13. The first connection 46 of the priority valve 45 and the control pressure space 49 can therefore also be connected, downstream of the pressure compensator, to the inflow to the directional valve 16. Such a design is shown in FIG. 2. The design according to FIG. 2 otherwise corresponds in full to that according to FIG. 1, so that reference may be made, in terms of its makeup and functioning, to the description of the first exemplary embodiment.

It may merely be pointed out in addition, with regard to the two designs according to FIGS. 1 and 2, that the load signaling line 38 is connected to the tank 12 via a flow regulator 55. The load signaling line 38 is in each case relieved of pressure via this flow regulator when none of the hydraulic consumers is actuated.

Figure 3:
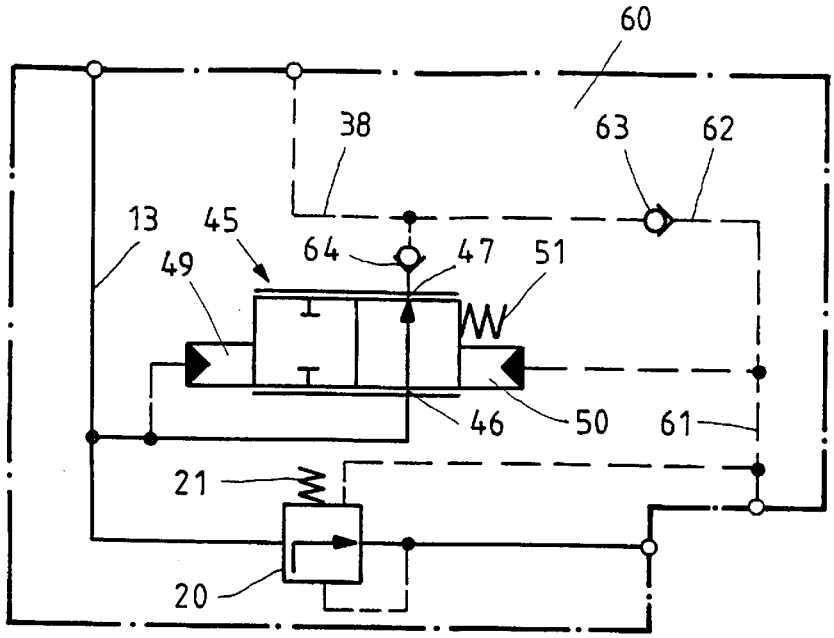
FIG. 3 shows a third exemplary embodiment, which has a bypass line around the priority valve.

FIG. 3 shows only the priority valve 45, the pressure compensator 20 and various pressure medium routes which lead toward and away from these two valves and which are located, together with the valves, in a housing 60. The design according to FIG. 3 is largely identical to the design according to FIG. 1 and may readily be supplemented by the components additionally shown in FIG. 1. The only difference from the design according to FIG. 1 is that, in this case, the control line 61, via which the control connection 18 of the directional valve 16 is connected to the control pressure space 50 of the priority valve 45 and to a control pressure space on the pressure compensator 20, is also connected to the load signaling line 38 via a nonreturn valve 63 located in a bypass line 62. At the same time, the nonreturn valve 63 blocks from the load signaling line 38 in the direction of the duct 61, that is to say the direction of the control connection 18 of the directional valve 16.

Furthermore, a nonreturn valve 64 is also arranged between the second connection 47 of the priority valve 45 and the load signaling line 38. Said nonreturn valve blocks in the direction of the connection 47.

In the design according to FIG. 1, the regulating spring 51 of the priority valve 45 determines the pressure drop at a metering diaphragm 17, even when a sufficient quantity of pressure medium is being conveyed, if the load pressure of the hydraulic consumer 14 to be supplied as primary consumer, minus the difference between the pressure equivalent to the force of the regulating spring 41 of the regulating valve 39 and the pressure equivalent to the force of the regulating spring 51 of the priority valve 45, is greater than the highest load pressure of all the actuated LUDV consumers 15. This is because a pressure is then set in the load signaling line 38, via the priority valve 45, which lies below the load pressure of the hydraulic consumer 14 to be supplied as primary consumer by the amount of the difference between the equivalent pressure of the regulating spring 41 and the equivalent pressure of the regulating spring 51, that is to say, for example in the case of a load pressure of 80 bar, an equivalent pressure of the regulating spring 41 of 20 bar and an equivalent pressure of the regulating spring 51 in the amount of 13 bar, it is 73 bar. In the event of undersaturation, the pressure in the load signaling line 38 rises above this value.

In the design according to FIG. 3, if a sufficient quantity of pressure medium is conveyed and the primary hydraulic consumer 14 is load-carrying, the load pressure of this hydraulic consumer is guided via the nonreturn valve 63 into the load signaling line 38. The pressure in the system of inflow lines 13 is therefore above the load pressure of the hydraulic consumer 14 by the amount of the equivalent pressure of the regulating spring 41, that is to say by the amount of the regulating Δp of the variable displacement pump 10, that is to say, in the case of a load pressure of, for example, 80 bar and a regulating Δp of, for example, 20 bar, it is 100 bar. Then, as in the case of a load-carrying second consumer 15, the pressure drop across a metering diaphragm 17 is determined by the force of the regulating spring 21 of the pressure compensator 20. Only when, in the event of undersaturation, the pressure in the system of inflow lines 13 has fallen to the sum of the load pressure of the hydraulic consumer 14 plus the pressure equivalent to the force of the regulating spring 51 of the priority valve 45, that is to say, for example, to 80 bar plus 13 bar equals 93 bar, the pressure drop across a metering diaphragm 17 of the directional valve 16 is 13 bar, that is to say is determined by the force of the regulating spring 51. A further reduction in the pressure drop across a metering diaphragm 17 does not occur, because, if undersaturation increases further, the pressure in the load signaling line 38 rises via the priority valve 45 and the pressure compensators 30 of the LUDV consumers are thereby adjusted in the closing direction.

The nonreturn valve 64 prevents a flow of pressure medium from the hydraulic consumer 14 via the nonreturn valve 63 into the system of inflow lines 13, insofar as, for example at the commencement of actuation, the pressure in the inflow lines is not yet above the load pressure.

What is claimed is:

1. Hydraulic control circuit for a primary first hydraulic consumer (14) and for a secondary second hydraulic consumer (15), comprising a first metering device (17), via which pressure medium can be supplied to the first hydraulic consumer (14) and via which a constant pressure difference can be set by means of a preceding pressure compensator (20), a second metering device (31), via which pressure medium can be supplied to the second hydraulic consumer (15) and which is followed by a second pressure compensator (30) which can be acted upon in the closing direction by a control pressure prevailing in a rear control space (34) and in the opening direction by the pressure downstream of the second metering device (31), a pressure medium source (10) of variable delivery quantity, which is controllable as a function of the highest load pressure of the actuated hydraulic consumers (14, 15) in such a way that the pressure in an inflow line (13) lies above the highest load pressure by the amount of a specific pressure difference, a load signaling line (38) which can be acted upon by the load pressure of the second hydraulic consumer (15) or by a pressure derived therefrom and which is connected to the rear control space (34) of the second pressure compensator (30) and to a regulating member (11) of the pressure medium source (10), and a priority valve (45) which has a first connection (46), connected to a line section (13) upstream of the first metering device (17), and a second connection (47), connected to the load signaling line (38), and a valve member (48) of which can be acted upon, in the direction of the opening of the connection between the first connection (46) and the second connection (47), by the load pressure of the primary hydraulic consumer (14) and by an additional force (51), wherein the valve member (48) of the priority valve (45) can be acted upon, in the direction of the closing of the connection between the first connection (46) and the second connection (47), by a pressure prevailing in a line section (13) upstream of the first metering device (17).

2. Hydraulic control circuit according to claim 1, wherein the valve member (48) of the priority valve (45) is acted upon in the opening direction by a spring (51).

3. Hydraulic control circuit according to claim 2, wherein the priority valve (45) is formed as a proportional valve.

4. Hydraulic control circuit according to claim 1, wherein the priority valve (45) is formed as a proportional valve.

5. Hydraulic control circuit according to claim 1, wherein the valve member (48) of the priority valve (45) can be acted upon in the direction of the closing by the pressure prevailing in the inflow line (13) upstream of the first pressure compensator (20).

6. Hydraulic control circuit according to claim 5, wherein a control pressure space (49) on the valve member (48) of the priority valve (45) and the first connection (46) of the priority valve (45) are connected to the inflow to the first metering device (17) upstream of the first pressure compensator (20).

7. Hydraulic control circuit according to claim 1, wherein a control pressure space (49) on the valve member (48) of the priority valve (45) and the first connection (46) of the priority valve (45) are connected to the inflow to the first metering device (17) on the same side of the first pressure compensator (20).

8. Hydraulic control circuit according to claim 1, wherein a flow point is connectable, downstream of the first metering device (17), to the load signaling line (38) via a bypass line (62), and that a nonreturn valve (63) opening toward the load signaling line (38) is arranged in the bypass line (62).

9. Hydraulic control circuit according to claim 8, wherein between the nonreturn valve (63) in the bypass line (62) and the second connection (47) of the priority valve (45) is arranged a nonreturn valve (64) blocking in the direction of this connection (47).

10. Hydraulic control circuit according to claim 1, wherein at least one of said metering devices is a variable restrictor.

* * * * *